US011007403B2

(12) United States Patent
Popescu

(10) Patent No.: US 11,007,403 B2
(45) Date of Patent: May 18, 2021

(54) TIRE FLIP SIMULATOR

(71) Applicant: Marius Popescu, Livermore, CA (US)

(72) Inventor: Marius Popescu, Livermore, CA (US)

( * ) Notice: Subject to any disclaimer, the term of this patent is extended or adjusted under 35 U.S.C. 154(b) by 0 days.

(21) Appl. No.: 16/139,011

(22) Filed: Sep. 22, 2018

(65) Prior Publication Data

US 2020/0346068 A1 Nov. 5, 2020

(51) Int. Cl.

| | |
|---|---|
| ***A63B 21/00*** | (2006.01) |
| ***A63B 21/008*** | (2006.01) |
| ***A63B 21/22*** | (2006.01) |
| ***A63B 21/005*** | (2006.01) |
| ***A63B 21/06*** | (2006.01) |
| *A63B 21/28* | (2006.01) |

(52) U.S. Cl.

CPC ..... *A63B 21/4049* (2015.10); *A63B 21/0051* (2013.01); *A63B 21/0084* (2013.01); *A63B 21/00192* (2013.01); *A63B 21/0615* (2013.01); *A63B 21/22* (2013.01); *A63B 21/00058* (2013.01); *A63B 21/28* (2013.01); *A63B 21/4035* (2015.10)

(58) Field of Classification Search

CPC ..... A63B 21/00058; A63B 21/00192; A63B 21/0051; A63B 21/005; A63B 21/22; A63B 21/28; A63B 21/4049; A63B 21/00069; A63B 21/00072; A63B 21/0615; A63B 19/00; A63B 19/02; A63B 19/04

See application file for complete search history.

(56) References Cited

U.S. PATENT DOCUMENTS

| | | | | |
|---|---|---|---|---|
| 9,717,941 | B2 * | 8/2017 | Gagnon | A63B 21/4047 |
| 10,022,580 | B2 * | 7/2018 | Tyree | A63B 21/0616 |
| D831,760 | S * | 10/2018 | Safranka | D21/686 |
| D862,618 | S * | 10/2019 | Gagnon | D21/680 |
| 2018/0264305 | A1 * | 9/2018 | Buckrell | A63B 21/00065 |
| 2019/0151702 | A1 * | 5/2019 | Grimes | A63B 21/0607 |

* cited by examiner

*Primary Examiner* — Megan Anderson
(74) *Attorney, Agent, or Firm* — Steven A. Nielsen; www.NielsenPatents.com

(57) ABSTRACT

An improved fitness/exercise apparatus using full or half tire that rotates 360 degrees about a fixed axle. A user lifts/pushes the tire, thus rotating the tire end over end, while the apparatus creates resistance to the rotation via a variety of means, such as a magnetic brake, a viscous brake, a pad and disc brake or a motor-controlled brake system.

5 Claims, 6 Drawing Sheets

TIRE FLIP SIMULATOR

BACKGROUND OF THE INVENTION

Tire flip training has been used for many years and is a great way to get fit. However, tractor tires take up a lot of room and it is often unsafe to have a large tire moving around the gym. Tire training requires a long and wide lane so that large rubber tires can be flipped repeatedly end-over-end from the starting point of the training zone to the finish line on the other end. Then, the exerciser moves around to the opposite side of the tire, reverses direction, and does it all over again until the exercise is complete. Large tires can weigh hundreds of pounds, making them a hazard to equipment, mirrors, and other exercisers who may happen to get in their way when mishandled, rolled out of control, or flipped off-balance in a direction not intended by the athlete. Since several tires of different diameters, width, and weight are needed to cater to those of various skill and strength levels, gym owners will also find themselves faced with a large number of tires taking up valuable real estate against the wall or in a corner of the gym better suited for other equipment. Landlords and neighboring tenants may not be eager to deal with runaway tires hitting parked cars, not to mention the potential liability of outdoor training with group fitness athletes running around in auto traffic zones. Tires can damage floors and leave marks on user's hands and clothes. Further, existing tire flip simulators only rotate 180 degrees, rely exclusively on gravity to provide resistance, and use only the floor to stop the rotation. As such, although tire flipping is a fantastic exercise, it comes with a long list of drawbacks. Hence, there is a need for a tire flipping machine that includes the benefits of the exercise, while at the same time eliminating the drawbacks.

DETAILED DESCRIPTION OF THE INVENTION

The Tire flip simulator is an apparatus that allows for a tire element (1) to be rotated on an axle (4). The tire element (1) can be made out of a number of molded sections which are then bolted together to form the shape of the tire element. Molding smaller sections which are then bolted together offers a cost-efficient benefit versus having to use a big tire and then cut it to desired size. Further, this type of "tire" can be made from a variety of materials, which can also be cleaned better and made safer than an actual vehicle tire. However, the invention is not limited to a tire molded from smaller components, and a vehicle tire could be used herein.

An important feature of the invention is that a user can remain on one side of the apparatus during use, without having to constantly switch sides after each rotation of the tire. As such, there needs to be a braking mechanism as part of the apparatus so that the tire comes to rest after each flip. Otherwise, there would be a risk of striking the user during the rotation. Further, the resistance to the rotation is an important element of the exercise and should be variable and at the control of the user.

Figure 1:
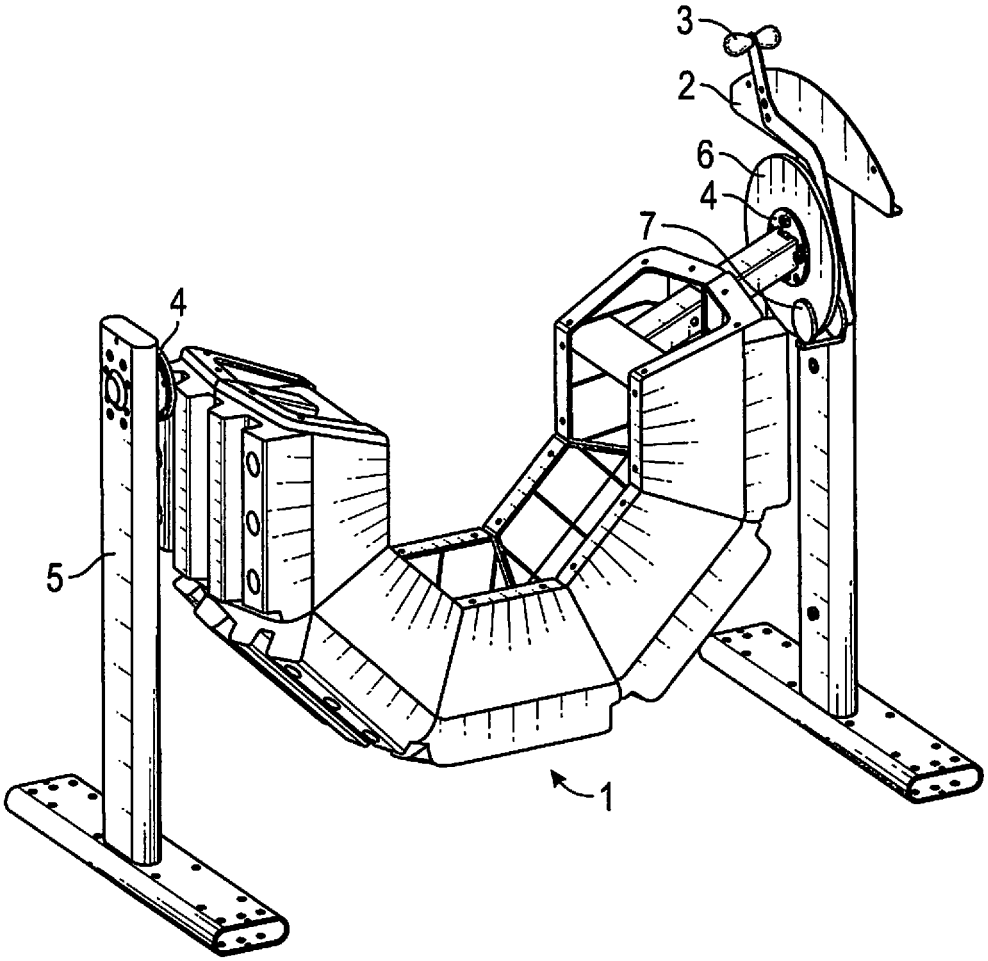
FIG. 1 shows a perspective view of the invention.
Figure 2:
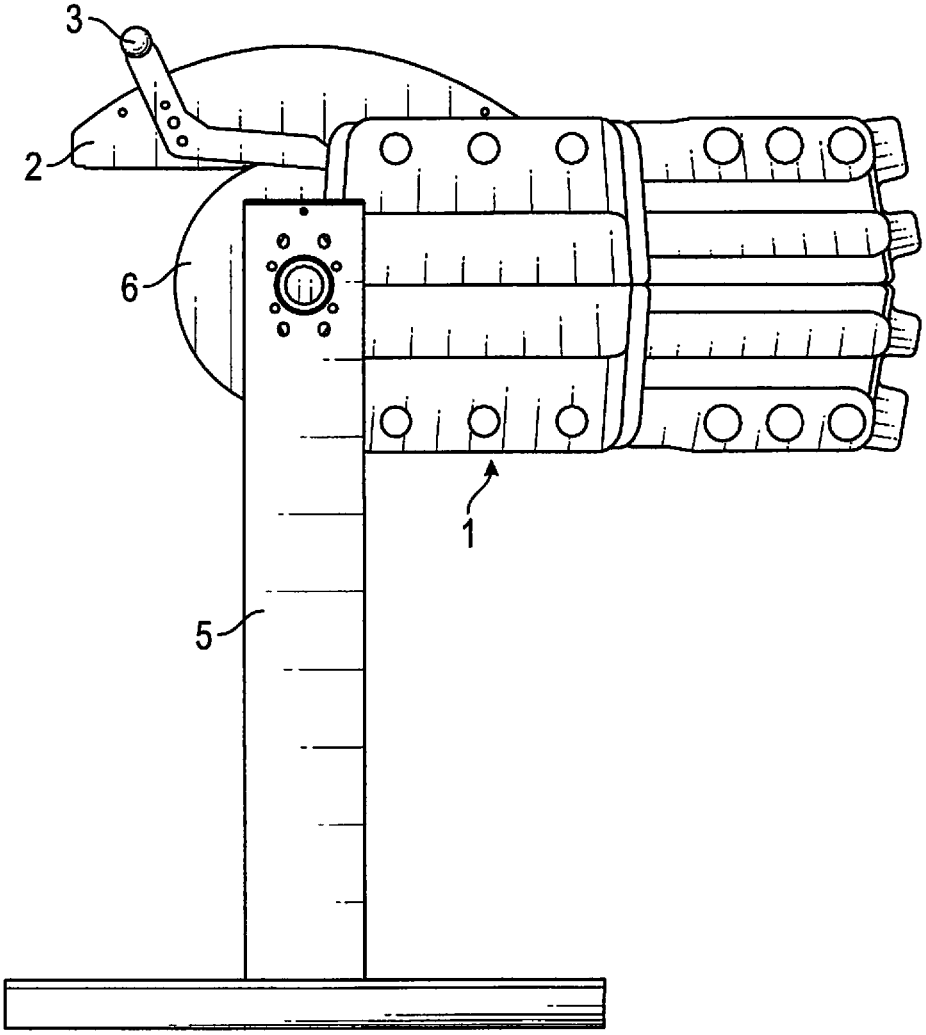
FIG. 2 shows the tire lifted to a partial rotation of 90 deg
Figure 3:
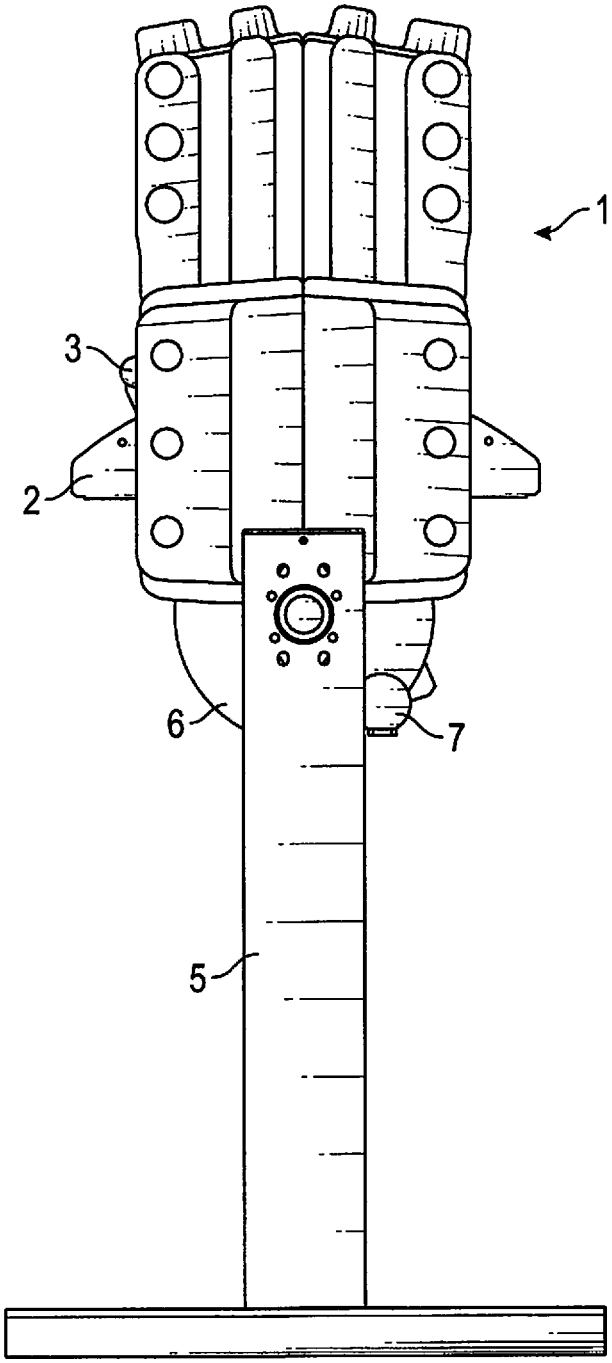
FIG. 3 shows the tire lifted to a partial rotation of 180 deg
Figure 4:
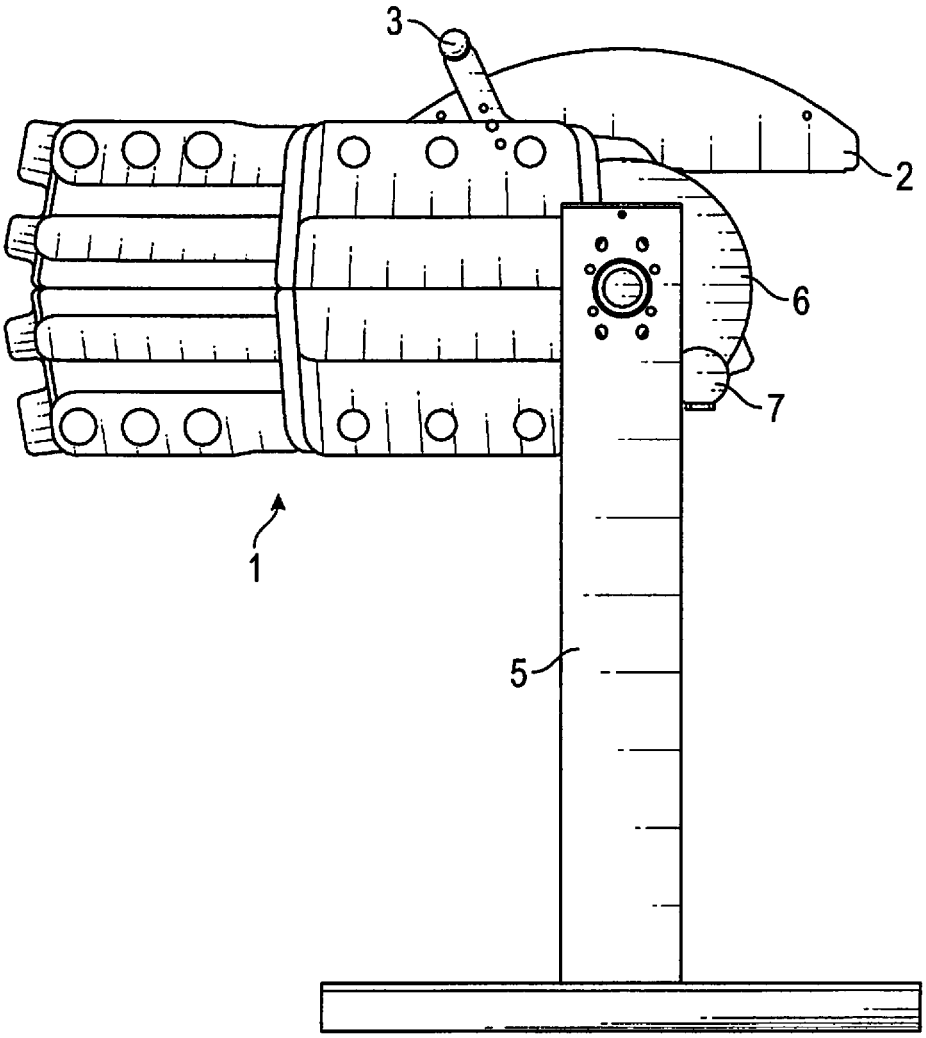
FIG. 4 shows the tire pushed over to a partial rotation of 270 deg
Figure 5:
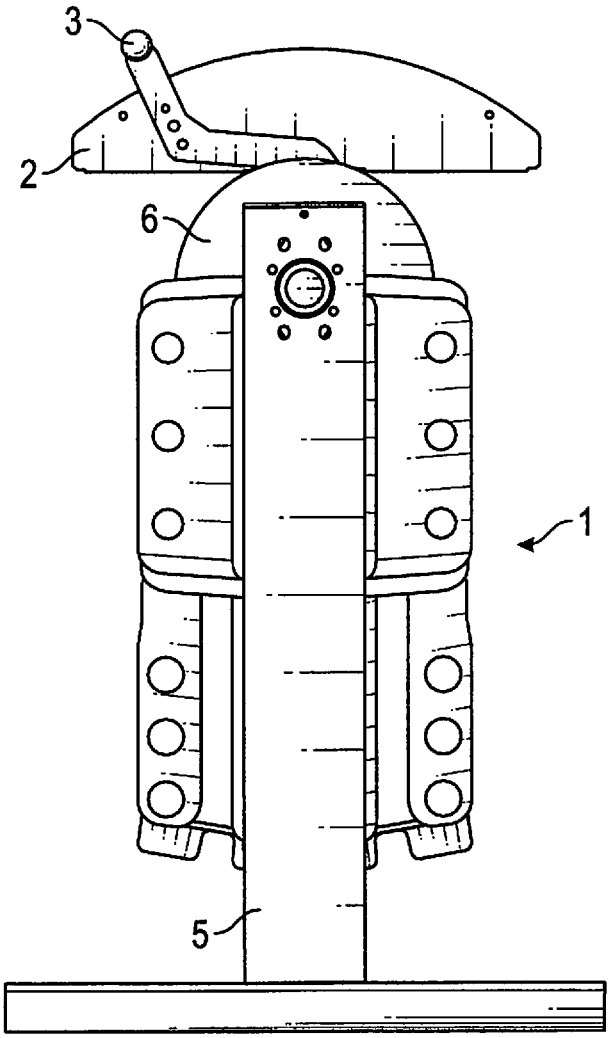
FIG. 5 shows the tire after a complete 360 deg rotation.

As such, the velocity of the tire element (and its resistance to rotation) is controlled with a braking mechanism. The braking mechanism may include any of the following: a magnetic brake, a viscous brake, a pad and disk brake, or a motor-controlled brake system. In the preferred embodiment, as shown in FIG. 1, the brake mechanism is a magnetic brake where magnets (7) are positioned on either side of a conductor disk (6) to create the phenomenon known as an Eddie Current Effect.

Eddy currents (also called Foucault currents) are loops of electrical current induced within conductors by a changing magnetic field in the conductor due to Faraday's law of induction. Eddy currents flow in closed loops within conductors, in planes perpendicular to the magnetic field. They can be induced within nearby stationary conductors by a time-varying magnetic field created by an AC electromagnet or transformer, for example, or by relative motion between a magnet and a nearby conductor. The magnitude of the current in a given loop is proportional to the strength of the magnetic field, the area of the loop, and the rate of change of flux, and inversely proportional to the resistivity of the material.

By Lenz's law, an eddy current creates a magnetic field that opposes the change in the magnetic field that created it, and thus eddy currents react back on the source of the magnetic field. For example, a nearby conductive surface will exert a drag force on a moving magnet that opposes its motion, due to eddy currents induced in the surface by the moving magnetic field. This effect is employed in eddy current brakes which are used to stop rotating power tools quickly when they are turned off. The current flowing through the resistance of the conductor also dissipates energy as heat in the material.

The term eddy current comes from analogous currents seen in water in fluid dynamics, causing localized areas of turbulence known as eddies giving rise to persistent vortices. Somewhat analogously, eddy currents can take time to build up and can persist for very short times in conductors due to their inductance.

Eddy Current Brake.

Figure 6:
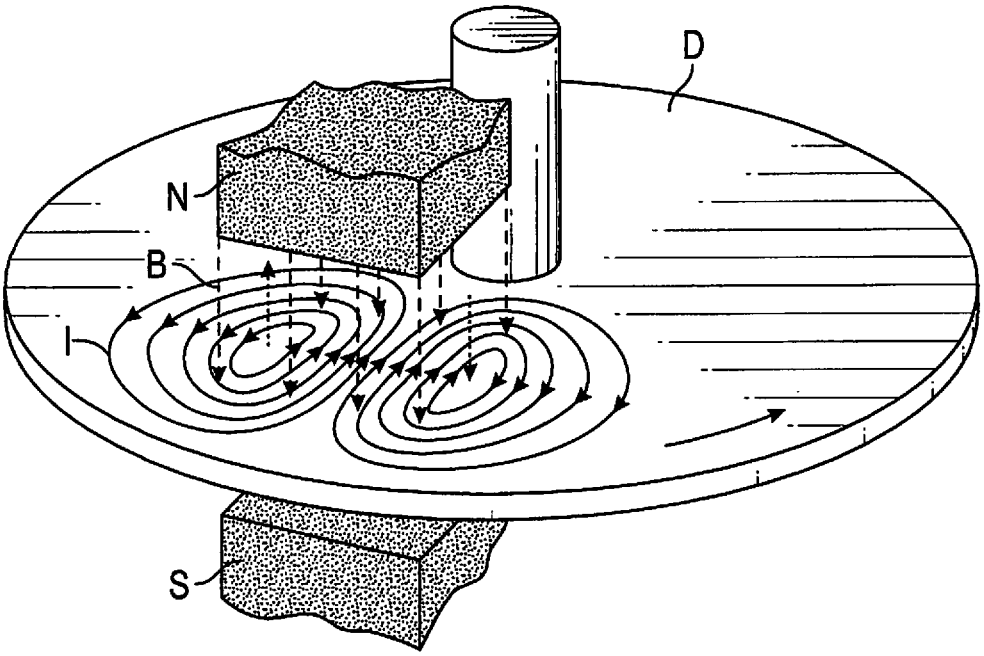
FIG. 6 shows illustrates an Eddy current brake.

A magnet induces circular electric currents in a metal sheet moving past it. FIG. 6 shows a metal sheet (C) moving to the right under a stationary magnet. The magnetic field (B, green arrows) of the magnet's north pole N passes down through the sheet. Since the metal is moving, the magnetic flux through the sheet is changing. At the part of the sheet under the leading edge of the magnet (left side) the magnetic field through the sheet is increasing as it gets nearer the magnet. From Faraday's law of induction, this creates a circular electric field in the sheet in a counterclockwise direction around the magnetic field lines. This field induces a counterclockwise flow of electric current (I, red), in the sheet. This is the eddy current. At the trailing edge of the magnet (right side) the magnetic field through the sheet is decreasing, inducing a second eddy current in a clockwise direction in the sheet.

Braking Elements

Eddy current brakes use the drag force created by eddy currents as a brake to slow or stop moving objects. Since there is no contact with a brake shoe or drum, there is no mechanical wear. Electrical resistance within the plates causes a dragging effect analogous to friction, which dissipates the kinetic energy of the moving parts of the apparatus. The same technique is used in electromagnetic brakes in railroad cars and to quickly stop the blades in power tools such as circular saws. Using electromagnets, as opposed to permanent magnets, the strength of the magnetic field can be adjusted and so the magnitude of braking effect changed.

In the preferred breaking mechanism, magnets (7) is linked to a shifter arm (3) which allows the user to manipulate the location of the magnets (7) on the conductor disk (6) by changing the location of the shifter arm (3) on the dial plate (2). By changing the location of the magnets (7) on the disk (6) the user not only controls the velocity of the tire component (1) as it comes down after it is pushed over but it also allows the increase or reduction of perceived resistance when the user lifts or pushes the tire component (1). This is due to the magnetic drag created on the conductor disk (6) as it spins, as discussed above.

The rotation of the tire element during use is either a full rotation of 360 degrees or partial rotation for specific exercises that do not require a full rotation, such as squats with the tire positioned on users shoulders. Bicep curls can be performed with the users holding the tire at waist height with arms fully extended and from that position performing the curl exercise. Benching exercises can be performed where the user is laying down on a bench with the tire positioned above the user at a 90 degree angle/parallel with the ground. Tossing the tire back and forth between two users can also be performed where each user is positioned on either side of the tire element (1) and catching the tire before it completes the rotation and pushing it back over to the opposite user.

Other than eddy currents, additional means of resistance to the rotational movement of the tire may comprise movement of one or mere objects through a viscous material, a pad and disk, or a motor.

The invention could utilize a dynamic drag control system which is coupled to the brake system. The brake system controls the speed and resistance the user feels during use. In certain embodiments, the drag mechanism can be excluded and just use the brake system to form a closed loop system. An electronic display can be used to relate performance data back to the user, such as duration of use, repetitions, resistance, and caloric use.

As the user lifts/flips the tire element, the apparatus provides resistance to the force via one of the following mechanisms, or combination of any of the following: gravity, a governor for dynamic drag adjustment and one of these brake mechanisms: a magnetic brake mechanism (eddy current mechanism), a viscous brake, fluid mill brake, wind mill brake, electric motor brake or a drum and pad/strap friction brake.

A governor is a mechanical subassembly which in the preferred embodiment, converts inertia (rotational) forces into linear (axial) forces. In the preferred embodiment it can be used to dictate when the brake engages and how hard it engages. One of the main benefits of a governor is that it allows for dynamic drag adjustment in an exercise apparatus where the drag level is a function of speed. The faster the governor spins, the higher the drag. As the speed is reduced, the drag reduces as well. In certain embodiments of this invention, the motion and forces of the governor are amplified with the help of gears, pulleys, belts, and/or sprockets with a roller chain in order to achieve sufficient inertial forces to properly apply brake to the system.

In another embodiment, the governor's inertia forces are transferred as axial forces to the brake system via a "shaft and notch" feature. The main shaft spins with the governor body. At one end, the shaft has an axial bearing, and at the opposite end it has a notch which is meant to interlock with the main body of the governor. The notch self-aligns with a through pin in the body of the governor.

In a different embodiment, a magnetic resistance brake system can be used. This type of mechanism uses a magnetic phenomenon known as eddy currents to generate drag and to control motion. This comprises one or more magnets which are placed within a certain controlled distance or angle from a conductive component such a copper, aluminum or steel disk/flywheel. Either by spinning the disk, or in the alternative, spinning the magnets and keeping the disk steady, this creates the magnetic phenomenon known as eddy currents which create drag when going through the conductive disk/flywheel. The drag is used as the braking force for the rotating tire element. The eddy current intensity can be adjusted by controlling the gap between the magnet and the conductive component. Eddy currents can also be adjusted by rotating (changing the angle) the magnetic field away from the conductive component, or by inserting a non-conductive element to partially or totally block the magnetic field from reaching the conductive component, thus controlling the amount of drag. The drag can also be controlled by changing the amount of magnet surface area which overlaps the conductive material of the disk/flywheel.

The magnetic field (eddy currents) can be amplified by using a "U" shaped magnetic metal strap and one magnet fixed to each of the two legs of the "U" shaped conductive strap. The two magnets would be oriented, so they repulse each other. Part of the spinning disk/flywheel would then be exposed to the magnetic field. As the disk spins through the magnetic field, drag is generated. From left to right the order sequence would be as follows to create the magnetic field eddy currents: left leg of the "U" strap, first magnet fixed to the left leg of the "U" strap, spinning disk/flywheel, second magnet fixed to the right leg of "U" strap, right leg of the conductive strap. The brake system could be connected to the tire element via belts and gears or chain and sprockets.

As a variation to an exercise apparatus which uses the above magnetic resistance brake system, in a different embodiment a governor mechanism could be added to dynamically control the amount of drag the system generates. The forces generated by the governor would control the amount of magnet overlapping the disk/flywheel, or in a different embodiment it would control the position of a nonconductive material in between the magnet/s and flywheel to block or expose the flywheel to the magnetic field generated by the magnets. In either embodiment, as more magnetic field passes through the conductive flywheel, the drag on the disk/flywheel increases. To some degree, the faster the flywheel spins the higher the amount of drag. But most of the drag is created by having more magnetic field going through the flywheel. A thicker flywheel will increase the drag, as well as moving the magnets from the center of the flywheel, thus creating a longer moment arm. The longer the moment arm, the higher the drag forces.

In another embodiment, a viscous brake mechanism can be used as the breaking system. A viscous brake mechanism uses three main elements to create drag: 1) an outer shell/housing, which houses; 2) a sealed rotor; and 3) a viscous material such as silicone, oil or hydraulic fluid which is placed between the rotor and the housing. When the rotor spins in the housing, the layer of viscous material between them is being sheared thus creating drag. Controlling the viscosity of the fluid or the amount of the fluid in the mechanism allows for drag control. Controlling the fluid amount usually requires a storage/exchange reservoir and one or more valves to control the amount of fluid used at any time. The brake system would be connected to the tire element via belts and gears or chain and sprockets.

As mentioned above, drag can be controlled by controlling the viscosity of the fluid. This can be done by changing the temperature of the viscous fluid. The lower the temperature of the fluid, the higher the viscosity, the higher the temperature of the fluid the lower the viscosity and as mentioned earlier, as viscosity increases so does the drag and vice versa.

Another way to control drag in the viscous brake system is by having adjustable features on the rotor such as blades or fins. Changing the angle of the blade/s similar to the way blades on airplane propeller change angle, will affect the drag within the viscous mechanism.

Another way to control drag within a viscous brake is to keep the viscous fluid constant and change the amount of rotor surface exposed to the fluid. The rotor could be formed in different shapes such as cylindrical or conical.

The basic properties of a viscous brake system allow for dynamic drag adjustment. As the rotor spins faster, the drag goes up, but there is a limit to the drag range as a function of rotor speed. The drag range can be further increased by dynamically adjusting the total surface area of the rotor that comes in contact with the viscous fluid at different speeds. Adding a governor to a viscous brake will allow for more dynamic drag adjustment by having the governor push more length of the rotor into the viscous fluid. As the rotor and governor spin together the inertia forces of the governor can push more of the rotor in the fluid thus increasing surface contact between fluid and rotor which translates into an increase in drag.

In another embodiment, a drum and pad or drum and strap mechanism can be used as a brake mechanism. The drum's ability to spin as the tire element is moved is controlled by the friction from a pad or a strap as it is pushed against the surface of the drum. The actuation of the pad can be magnified by having a spring attached to this strap and stretching the strap by pulling on the spring. The spring acts as a magnifier for the tension of the strap. The brake system would be connected to the tire element via belts and gears or chain and sprockets.

Just as with a magnet and flywheel mechanism or with a viscous brake, in another embodiment a governor can be used to dynamically control the brake amount for a drum and pad, or drum and strap mechanism. The governor would dynamically control the pressure between a drum and pad, or drum and strap. In another embodiment, the governor would dynamically control the amount of contact surface area between the spinning flywheel and brake pad or strap. In either embodiment, the speed of the tire element will directly impact the actuation of the governor, which in turn will change the amount of drag the brake system will generate.

In another embodiment, a fluid mill can be the brake system. A fluid mill is made of three main components: a container which can be sealed, fluid such as water, and a rotor with fins which would spin through the fluid. The brake system would be connected to the tire element via belts and gears or chain and sprockets. In this brake system, the size of fluid ports in the container can be adjusted to change the amount of fluid moving through the enclosed container. This dictates the resistance the blades will encounter as they spin.

In another embodiment, a governor can be used to dynamically control the drag generated by the fluid mill by using the governor to control the size of the fluid ports in the mill container.

In another embodiment, a wind mill can be used as a break mechanism. This mechanism uses a rotor with blades and air resistance to generate drag. Lifting or pushing the tire element would spin the rotor blades. Controlling the angle of the blades to control the amount of blade surface exposed to direct air flow would create brake adjustment. Further, more as with most of the brake mechanisms described herein, to some extent drag is a function of speed, so the faster the tire element is moving, the faster the rotor will spin, causing increased drag.

In another embodiment, a governor can be used to dynamically control the angle of the blades on the rotor. The governor can also control when the rotor will spin at a specific speed.

With all of the above brake systems, a function of the governor is to allow for dynamic adjustment and to invert the drag curve so at low RPM, the drag is low and as the RPM increases, the drag increases.

In other embodiments of this invention, the governor and brake system can be replaced by an electric motor which is mechanically linked to the rope via sprockets and chains, and/or gears, and/or pulleys with belts. By controlling the current that drives the motor one can control the speed with which the motor spins, thus controlling the speed of the tire element.

Different exercises for different body parts and muscles can be performed at different angle/position of the tire other that just simply pushing the tire over through a 360 full rotation.

The invention also requires a support structure 5 that secures the tire element in a stable manner, as well as the other components of the invention. Due to the significant forces being applied to the apparatus, the support structure is preferably heavy enough to remain stationary during use or secured to the floor.

What is claimed is:

1. A tire flip simulator, comprising:

a. a support structure;

b. a tire element affixed to the support structure by use of an axle wherein the tire element is capable of 360 degrees of rotation about a horizontal axis, wherein the axle and the horizontal axis is are not parallel to each other; and c. resistance to the rotation of the tire element by use of a conductor disk attached to the axle, with the conductor disk comprising two sides;

d. a plurality of magnets in magnetic communication the two sides of the conductor disk.

2. The tire flip simulator of claim 1, further comprising:

a. a shifter arm, attached to the plurality of magnets, wherein the shifter arm is capable of adjusting the position of the plurality of magnets with respect to the conductor disk.

3. The tire flip simulator of claim 2, further comprising:

a. a dial plate (2) affixed to the support structure, the position of the shifter arm with respect to the dial plate indicating a level of resistance to the rotation of the tire element.

4. The tire flip simulator of claim 1, wherein the plurality of magnets in magnetic communication with the conductor disk create a means of resistance to rotation of the tire element and create magnetic eddy currents.

5. The tire flip simulator of claim 4, wherein the magnetic eddy currents are adjusted by changing the position of the plurality magnets via the shifter arm.

* * * * *